US006247976B1

(12) United States Patent
Chiu

(10) Patent No.: US 6,247,976 B1
(45) Date of Patent: Jun. 19, 2001

(54) FEMALE TERMINAL

(75) Inventor: Allen Chiu, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/360,770

(22) Filed: Jul. 26, 1999

(30) Foreign Application Priority Data

Jan. 12, 1999 (TW) ..... 88200434

(51) Int. Cl.[7] ..... H01R 11/22
(52) U.S. Cl. ..... 439/857
(58) Field of Search ..... 439/636, 733.1, 439/856, 876, 857, 843, 362

(56) References Cited

U.S. PATENT DOCUMENTS 3,525,972 * 8/1970 Asick et al. ..... 439/876
3,696,319 * 10/1972 Olsson ..... 439/843

* cited by examiner

*Primary Examiner*—Neil Abrams
*Assistant Examiner*—Phuong Dinh
(74) *Attorney, Agent, or Firm*—Wei Te Chung

(57) ABSTRACT

A female terminal comprises a base, a pair of mounting portions vertically extending from opposite edges of the base and a pair of mating portions extending from other opposite edges of the base in a direction opposite from that of the mounting portions. The mating portion forms a spring arm, a contact section and a guidance portion. The contact sections define an angle therebetween, and the angle between the contact sections approaches zero when a male terminal is inserted into and connects with the female terminal, thereby causing the male terminal to connect with the contact sections substantially in a plane. Thus, the male terminal and the corresponding female terminal are reliably connected.

9 Claims, 6 Drawing Sheets

FEMALE TERMINAL

BACKGROUND OF THE INVENTION

The present invention relates to a female terminal.

Electrical connectors are used to connect two or more electrical devices and transfer electrical signals therebetween. Terminals play an important role in signal transfer and the structure of the terminals governs the quality of signal transfer. Taiwan Patent Application No. 86204343 discloses a female terminal as shown in FIGS. 1 and 2. The female terminal 10 comprises a rectangular base 12, a pair of mounting sheets 14, and a pair of mating sheets 16. The mounting sheets 14 vertically extend from opposite edges of the base 12. The mating sheets 16 extend from other opposite edges of the base 12 in a direction opposite from that of the mounting sheets 14. The mating sheets 16 each form a conjoint portion 18 abutting against each other. A male terminal 20 is inserted between the sheets 18 to electrically connect with the female terminal 10. However, the male terminal 20 only contacts the conjoint portions 18 along a line; thus, the connection therebetween is unreliable. Hence, an improved female terminal is required to overcome the disadvantages of the prior art.

BRIEF SUMMARY OF THE INVENTION

An object of the present invention is to provide a female terminal for making a reliable connection with a corresponding male electrical engaging element.

Accordingly, a female terminal comprises a base, a pair of mounting portions vertically extending from opposite edges of the base and a pair of mating portions extending from other opposite edges of the base in a direction opposite from that of the mounting portions. The mating portion forms a spring arm, a contact section and a guidance portion. The contact sections define an angle in their unengaged states, and the angle between the contact sections approaches zero when a male terminal is inserted into and connects with the female terminal. This allows the male terminal to connect with the contact sections of the female terminals substantially in a plane. Thus, the male terminal and the corresponding female terminal are reliably connected.

Other objects, advantages and novel features of the invention will become more apparent from the following detailed description of the present embodiment when taken in conjunction with the accompanying drawings.

DETAILED DESCRIPTION OF THE INVENTION

Figure 1:
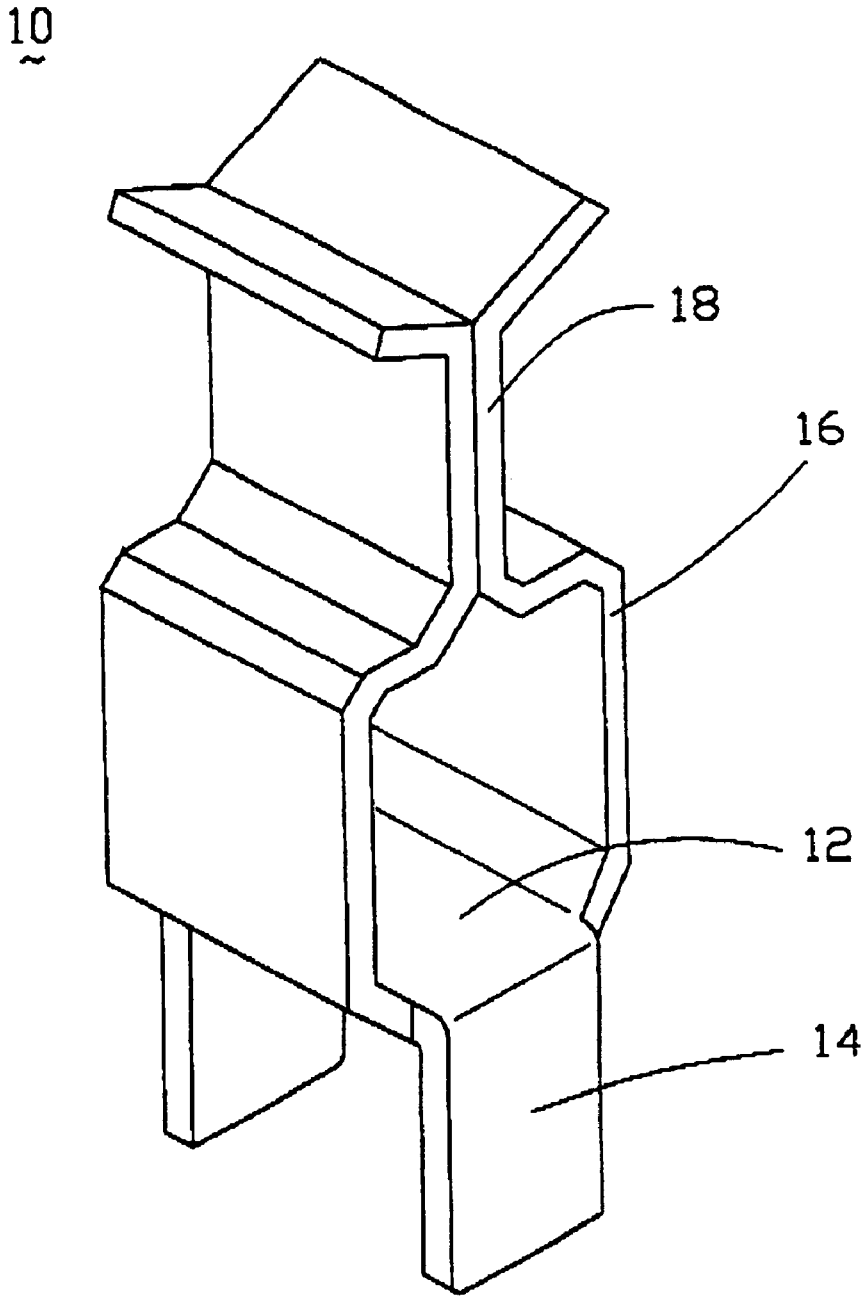
FIG. 1 (PRIOR ART)
FIG. 1 is a perspective view of a female terminal of the prior art.
Figure 2:
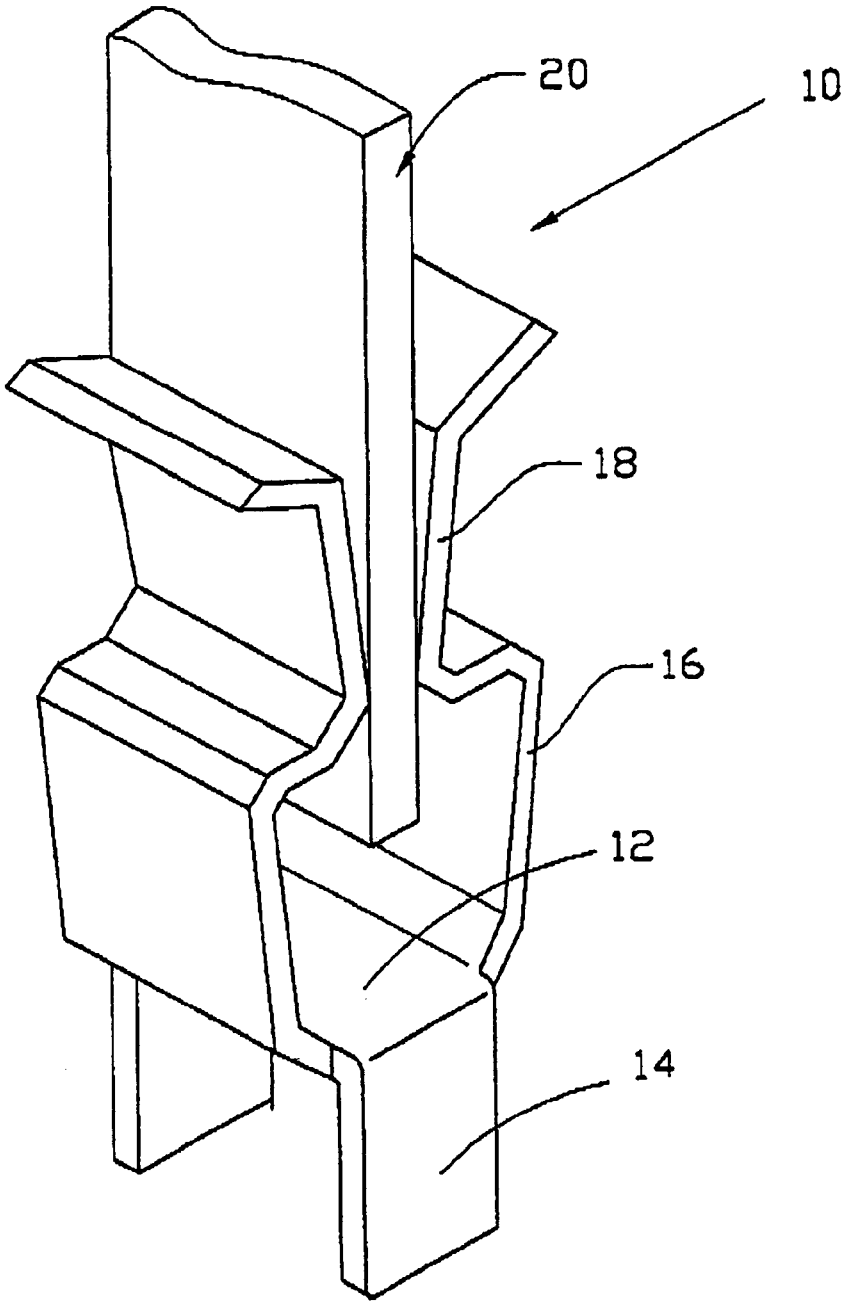
FIG. 2 (PRIOR ART)
FIG. 2 is a view similar to FIG. 1 with a male terminal connected with the female terminal.
Figure 3:
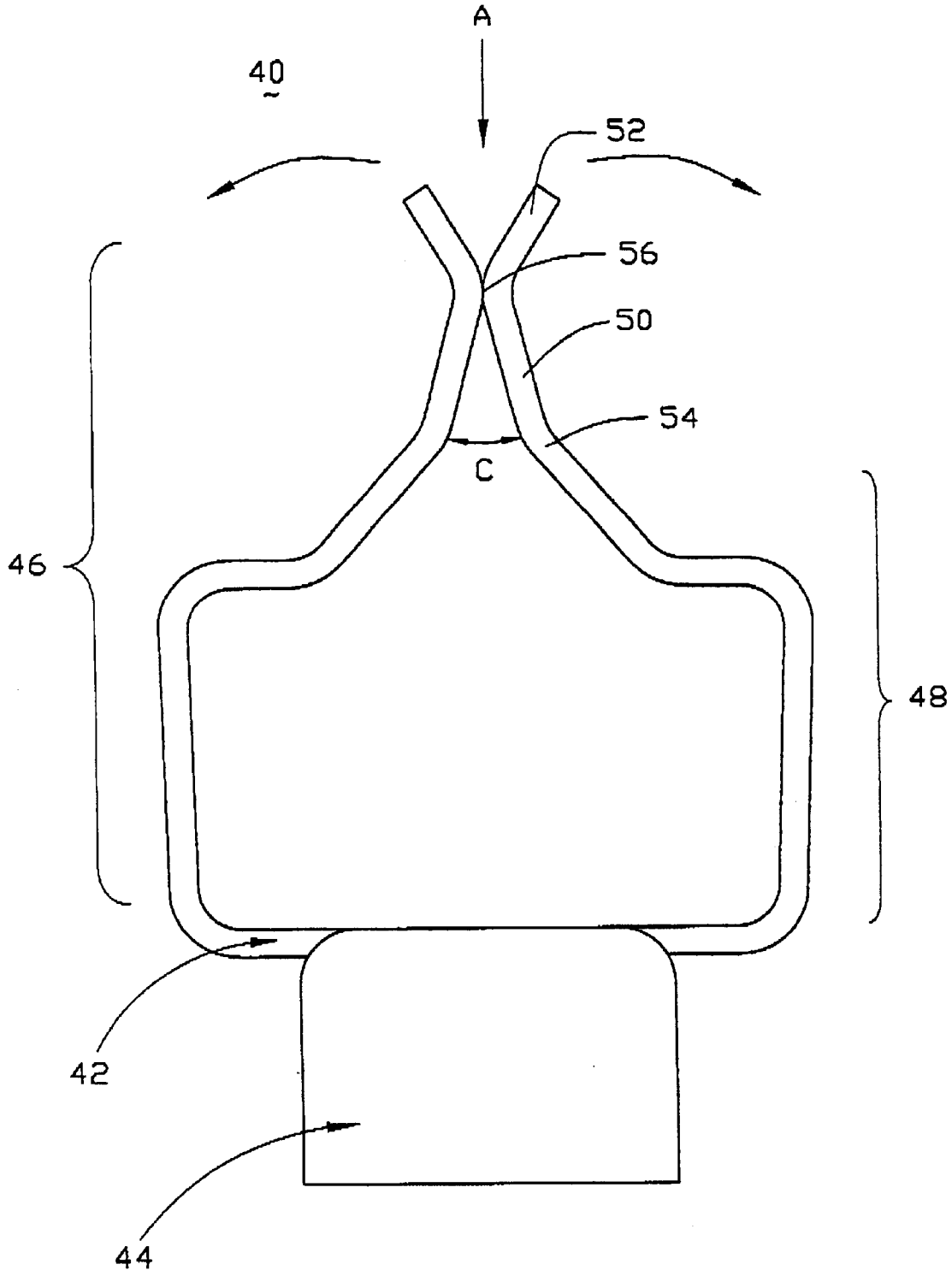
FIG. 3 is a planar view of a female terminal of a first embodiment of the present invention.

Referring to FIG. 3, a female terminal 40 in accordance with a first embodiment of the present invention comprises a base 42, a pair of mounting portions 44 and a pair of mating portions 46. The base 42 is a planar plate. The mounting portions 44 vertically extend from opposite edges of the base 42. The mating portions 46 extend from other opposite edges of the base 42 in a direction opposite from that of the mounting portions 44. Each mating portion 46 forms a spring arm 48, a contact section 50 and a guidance portion 52. A rounded point 54 is formed between the contact section 50 and the spring arm 48, and an abutting point 56 is formed between the contact section 50 and the guidance portion 52. The contact sections 50 define a predetermined angle "C" between inside faces thereof when nothing is inserted in the female terminal 40. The mating portions 46 abut against each other at the abutting points 56 and a pre-stress is formed therebetween.

Figure 4:
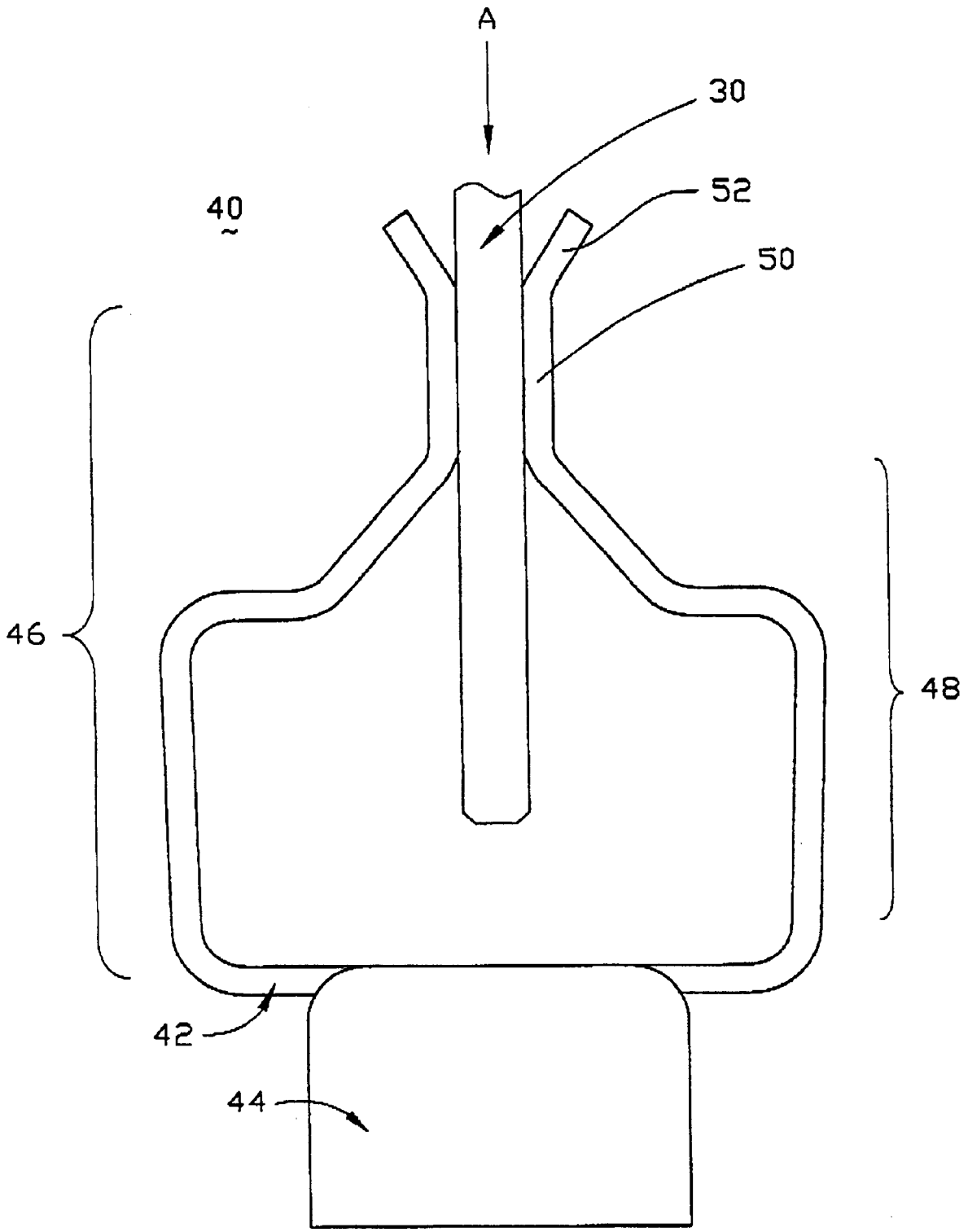
FIG. 4 is a view similar to FIG. 3 with a male terminal connected with the female terminal.

Also referring to FIG. 4, when a male terminal 30 is inserted into and connects with the female terminal 40 in the direction of "A", the male terminal 30 presses inside faces of the guidance portions 52 to force free ends of the mating portions 46 to move outwardly (FIG. 3). The abutting points 56 are separated from each other and a space is formed therebetween. When the width of the space equals the thickness of the male terminal 30, the male terminal 30 slides between the contact sections 50 and abuts against an inside face of each contact section 50 by opposite surfaces thereof. During this process, each contact section 50 rotates by an angle equal to half of the angle "C". Thus, each surface of the male terminal 30 adjacent the contact sections 50 connects the inside face of each contact section 50 substantially in a plane, and the male terminal 30 and the female terminal 40 are reliably connected.

Figure 5:
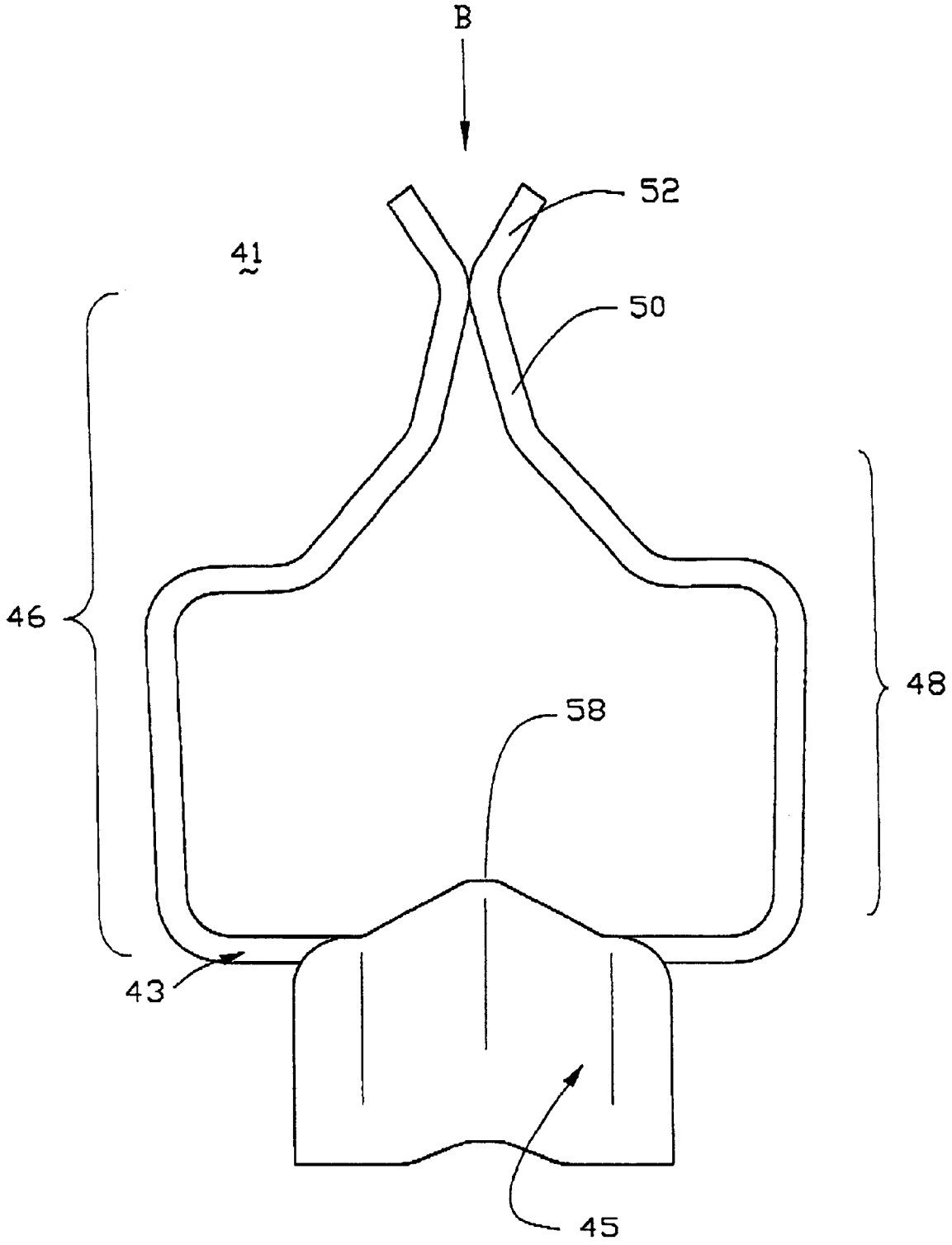
FIG. 5 is a planar view of a female terminal of a second embodiment of the present invention.
Figure 6:
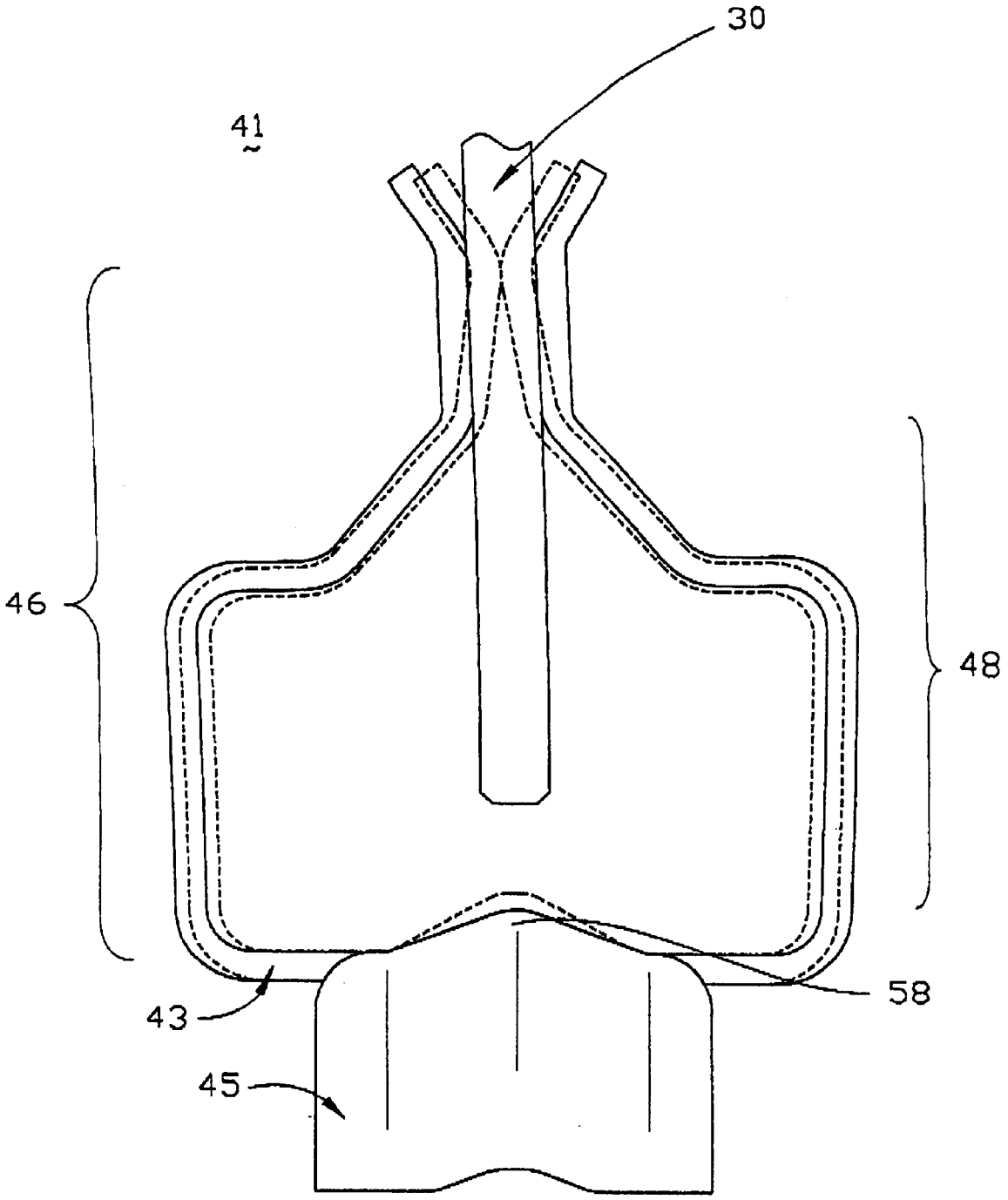
FIG. 6 is a view similar to FIG. 5 with a male terminal connected with the female terminal.

A second embodiment of the present invention is shown in FIGS. 5 and 6. The female terminal 41 is similar to the female terminal 40 of the first embodiment except that the base 43 and the pair of mounting portions 45 form a waved protrusion 58 at a middle portion thereof. When the male terminal 30 is inserted into and connects with the female terminal 41 in the direction of "B", a process similar to that occurring with the first embodiment occurs. The waved protrusion 58 is pulled in opposite directions to become flattened and an end adjacent the base 43 of the mating portion 46 moves a predetermined distance outwardly to adapt to the size of the male terminal 30. A big male terminal produces a larger pull force, forcing the mating portion 46 to move a greater predetermined distance outwardly than a small male terminal does, but the contact section 50 rotates through the same angle. Thus, the female terminal 41 is suitable to connect with male terminals 30 having different sizes. The dotted line and the solid lines in FIG. 6 respectively show an original state of the female terminal 41 and a final state. Other embodiments are possible where the base 43 may form more protrusions at positions proximate the mating portion 46 (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A female terminal for connecting with a male terminal of the type having a pair of opposing contact surfaces, the female terminal comprising:

a base having a pair of first opposite edges and a pair of second opposite edges;

a pair of mounting portions downwardly extending from the first opposite edges of the base;

a pair of mating portions extending from the second opposite edges of the base in a direction opposite from that of the mounting portions; and a pair of contact sections formed on the mating portions, each contact section having an opposing planar face, the planar faces defining a predetermined angle therebetween, the angle between the faces approaching zero when the male terminal is inserted between the pair of contact sections, with each planar face contacting a corresponding opposing contact surface of the male terminal substantially in a plane;

wherein the base forms a waved protrusion which is stretchable toward the opposite mating portions when the male terminal mates with the female terminal.

2. The female terminal as claimed in claim 1, wherein the mating portion comprises a spring arm connected between the contact section and the base.

3. The female terminal as claimed in claim 2, wherein each mating portion forms a guidance portion at a free end thereof.

4. The female terminal as claimed in claim 3, wherein an abutting point is formed between the contact section and the guidance portion, the mating portions abutting against each other at the abutting point when no male terminal is inserted therebetween and a pre-stress being present therebetween.

5. A female terminal for connecting with a male terminal of the type having a pair of opposing contact surfaces, the female terminal comprising:

a base having a mounting portion downward extending and a pair of mating portions upward extending therefrom;

said pair of mating portions defining a pair of contact sections with a pair of opposing planar faces thereon, said pair of opposing planar faces commonly defining therebetween a downward facing acute angle, said pair of opposing planar faces being deflected into a parallel relation with each other when the male terminal is inserted between the pair of contact sections, with said pair of opposing planar faces respectively contacing the contact surfaces of the corresponding male terminal;

wherein the base forms a waved protrusion which is stretchable toward the opposite mating portions when the male terminal mates with the female terminal.

6. A terminal assembly comprising:

a female terminal including:

a base with a mounting portion and a pair of mating portions respectively extending downward and upward therefrom;

a pair of contact sections formed on the mating portions, said pair of contact sections defining a pair of opposing planar faces, said pair of opposing planar faces commonly defining therebetween a downward facing acute angle; and a male terminal of the type having a pair of opposing contact surfaces, a distance between said pair of opposing contact surfaces being properly dimensioned to have the pair of opposing planar faces of the female terminal outward deflected, when the male terminal is inserted into the female terminal, until the pair of opposing planar faces are parallel to each other and respectively fully engaging said pair of opposing contact surfaces of the male terminal;

wherein the base forms a waved protrusion which is stretchable toward the opposite mating portions when the male terminal mates with the female terminal.

7. The female terminal as claimed in claim 1, wherein the amount the waved protrusion stretches is relative to and adjustable by the thickness of the male terminal, the female terminal thereby being adaptable for mating with male terminals having different thicknesses.

8. The female terminal as claimed in claim 5, wherein the amount the waved protrusion stretches is relative to and adjustable by the thickness of the male terminal, the female terminal thereby being adaptable for mating with male terminals having different thicknesses.

9. The terminal assembly as claimed in claim 6, wherein the amount the waved protrusion of the female terminal stretches is relative to and adjustable by the thickness of the male terminal, the female terminal thereby being adaptable for mating with male terminals having different thicknesses.

* * * * *